US009861152B1

(12) United States Patent
Rumfelt

(10) Patent No.: US 9,861,152 B1
(45) Date of Patent: Jan. 9, 2018

(54) METHOD AND APPARATUS FOR IMPROVED HELMET

(71) Applicant: Robert Rumfelt, Opelika, AL (US)

(72) Inventor: Robert Rumfelt, Opelika, AL (US)

( * ) Notice: Subject to any disclaimer, the term of this patent is extended or adjusted under 35 U.S.C. 154(b) by 315 days.

(21) Appl. No.: 14/533,205

(22) Filed: Nov. 5, 2014

(51) Int. Cl.

| | |
|---|---|
| ***A63B 71/10*** | (2006.01) |
| ***A42B 3/00*** | (2006.01) |
| ***A41D 27/26*** | (2006.01) |
| ***A41D 13/00*** | (2006.01) |
| ***A42B 3/04*** | (2006.01) |
| ***A42B 3/20*** | (2006.01) |
| ***A42B 3/16*** | (2006.01) |
| ***A41D 13/05*** | (2006.01) |
| ***A42B 3/06*** | (2006.01) |

(52) U.S. Cl.
CPC ..... *A42B 3/0473* (2013.01); *A41D 13/0512* (2013.01); *A42B 3/06* (2013.01); *A42B 3/16* (2013.01); *A42B 3/20* (2013.01); *A63B 71/10* (2013.01)

(58) Field of Classification Search
CPC ..... A42B 3/00; A42B 3/04; A42B 3/0473; A42B 3/06; A42B 3/16; A42B 3/18; A42B 3/20; A63B 71/10; A63B 71/12; A63B 71/1291; A41D 13/015; A41D 13/0512
USPC ..... 2/1, 6.6, 6.8, 410, 411, 413, 414, 421, 2/424, 425, 455, 459, 461–464, 467, 468
See application file for complete search history.

(56) References Cited

U.S. PATENT DOCUMENTS

| | | | | | |
|---|---|---|---|---|---|
| 1,244,559 | A | * | 10/1917 | Stocks | A42B 3/064 2/411 |
| 3,134,106 | A | | 5/1964 | Shaffer et al. | |
| 3,707,004 | A | * | 12/1972 | Kapitan | A42B 3/0473 128/201.23 |
| 4,999,855 | A | * | 3/1991 | Brown | A42B 3/0473 2/421 |
| 5,287,562 | A | | 2/1994 | Rush, III | |
| 5,295,271 | A | | 3/1994 | Butterfield et al. | |
| 5,353,437 | A | * | 10/1994 | Field | A41D 13/0153 2/421 |
| 5,493,736 | A | | 2/1996 | Allison | |
| 5,930,843 | A | | 8/1999 | Kelly | |
| 6,067,665 | A | * | 5/2000 | DePalma | A41D 13/0512 2/44 |
| 6,385,781 | B1 | * | 5/2002 | Rose | A42B 3/00 2/421 |
| 6,434,756 | B1 | * | 8/2002 | Hoop | A41D 13/0512 2/425 |

(Continued)

*Primary Examiner* — Jameson Collier
(74) *Attorney, Agent, or Firm* — George L Williamson

(57) ABSTRACT

Method and apparatus for improved helmet having an outer shell with a face mask disposed thereon along with an inner shell so that the outer shell floats without the inner and outer shells separating while maintaining an air gap between the inner shell and the head of a user which prevents direct contact between the helmet and the head or neck of a user. An outer collar closely surrounds the sides and back of the outer shell and is attached to the shoulder pads preventing direct impact to the rear of the outer shell and also much of the area behind the ear of a user. Gel pads are placed between the two helmet shells and the top of the helmet collar and between the shoulder, chest and back pads and the body of the user. A head and neck restraint and third-party neck brace are also shown.

9 Claims, 3 Drawing Sheets

(56) References Cited

U.S. PATENT DOCUMENTS

| | | | | |
|---|---|---|---|---|
| 6,588,022 | B1 * | 7/2003 | Anders | A42B 3/00 2/421 |
| 8,230,852 | B2 * | 7/2012 | Zhang | A62B 18/003 128/200.28 |
| 8,321,965 | B2 | 12/2012 | Newman | |
| 2006/0096010 | A1 * | 5/2006 | Glaser | A42B 3/0473 2/411 |
| 2012/0167289 | A1 * | 7/2012 | Kim | A41D 13/0512 2/461 |
| 2012/0278980 | A1 * | 11/2012 | Chuback | A41D 13/0512 2/461 |
| 2013/0031706 | A1 * | 2/2013 | Cooksey | A41D 13/0512 2/459 |
| 2013/0055492 | A1 * | 3/2013 | Husain | A42B 3/0473 2/468 |
| 2013/0091624 | A1 * | 4/2013 | Czajka | A41D 13/1209 2/456 |
| 2013/0128046 | A1 * | 5/2013 | Gindin | G07C 5/0891 348/148 |
| 2013/0185837 | A1 * | 7/2013 | Phipps | A42B 3/12 2/2.5 |
| 2014/0020161 | A1 * | 1/2014 | Mason | A41D 13/015 2/462 |
| 2014/0283286 | A1 * | 9/2014 | Yoon | A42B 3/069 2/411 |
| 2015/0164172 | A1 * | 6/2015 | Linares | A42B 3/0473 2/411 |
| 2016/0037850 | A1 * | 2/2016 | Benson | A42B 3/0473 2/411 |

* cited by examiner

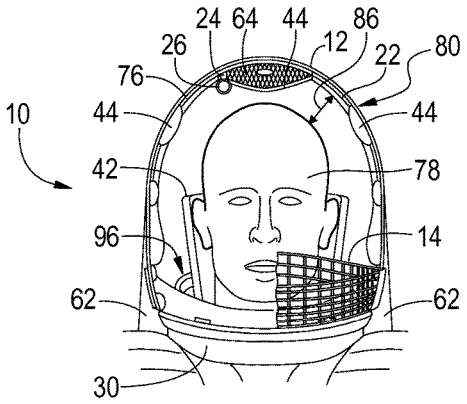
FIG. 3
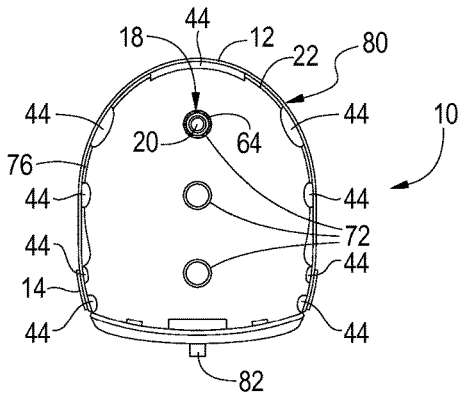
FIG. 4
FIG. 5
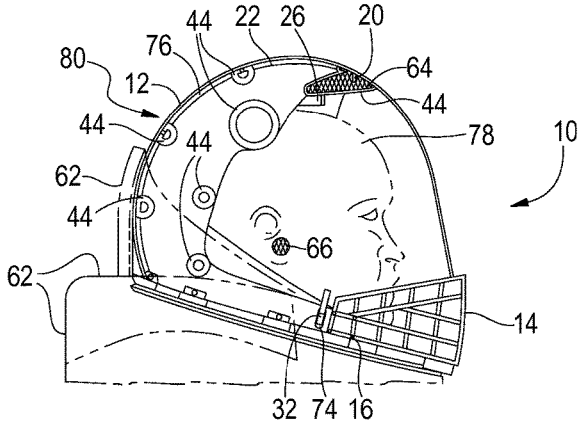
FIG. 6
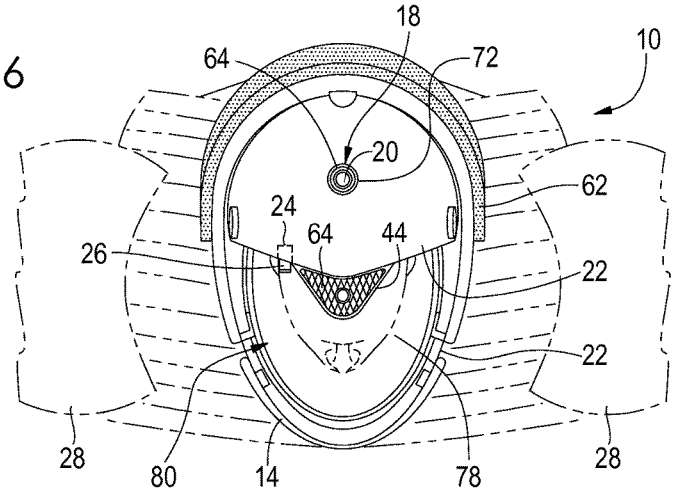

METHOD AND APPARATUS FOR IMPROVED HELMET

BACKGROUND OF THE INVENTION

Field of the Invention

The present invention relates generally to headgear and, more particularly, is concerned with a helmet for use in activities known to be hazardous to the head and neck such as sporting activities or the like.

Description of the Related Art

Devices relevant to the present invention have been described in the related art, however, none of the related art devices disclose the unique features of the present invention.

In U.S. Pat. No. 3,134,106 dated May 26, 1964, Shaffer, et al., disclosed a protective football apparatus. In U.S. Pat. No. 8,321,965, dated Dec. 4, 2012, Newman disclosed a combined head and neck protector. In U.S. Pat. No. 5,930,843 dated Aug. 3, 1999, Kelly disclosed a helmet and shoulder harness assembly providing cervical spine protection. In U.S. Pat. No. 5,493,736 dated Feb. 27, 1996, Allison disclosed a sports helmet protective device. In U.S. Pat. No. 5,295,271 dated Mar. 22, 1994, Butterfield, et al., disclosed a shoulder rest helmet. In U.S. Pat. No. 5,287,562 dated Feb. 22, 1994, Rush, III disclosed a helmet to protect the cervical spine against axial impact forces.

While these devices may be suitable for the purposes for which they were designed, they would not be as suitable for the purposes of the present invention as hereinafter described.

SUMMARY OF THE PRESENT INVENTION

The present invention discloses an improved helmet having an energy absorbing outer shell having a high impact face mask disposed thereon along with an inner shell so that outer shell floats thereby absorbing maximum impact energy without the inner and outer shells separating while maintaining an approximate 2.5 inch air gap between the inner shell and the head of a user which prevents direct contact between any part of the present invention and the head or neck of a user. A protective outer collar closely surrounds the sides and back of the outer shell and is attached to the shoulder pads thereby preventing direct impact to the rear of the outer shell and also much of the area behind the ear of a user. Impact gel pads are placed between the two helmet shells and the top of the helmet collar to further reduce impacts that do not reach the helmet. Energy that remains and is transmitted to the shoulder and torso is further reduced by impact gel strips placed between the shoulder and torso and by impact gel strips placed between the shoulder, chest and back pads and the wearer's body.

To reduce residual (secondary) energy at the head and neck a vertical head and neck flexible restraint incorporated into the shoulder pad is included so that it closely surrounds the back half of the neck and the head. Also, a third party neck brace may be used. When impact causes the head and neck to move sideways or backwards, the head and neck restraint is contacted and provides progressive resistance to decelerate and to prevent over-extension of the head/neck. Likewise, the optional neck brace decelerates forward motion of the head and neck. Thus, many secondary injuries can also be eliminated.

This helmet/pads design radically changes the way the head and spine are protected. Every other helmet design keeps the head in contact with the helmet in some fashion, typically using a shock absorption medium (foam, air, pads, etc.) which still transmits significant energy from the outer shell directly to the head. This new design completely eliminates direct contact with the head by placing the protective shell approximately 2.0-2.5 inches from the head and neck at all points. As such, this is the first and only helmet design that prevents all direct energy from reaching the head, brain and neck. In addition, inner and outer protective collars and impact-dampening gel pads greatly reduce secondary energy, further reducing forces to the neck and head. While shock systems are used elsewhere, none have the unique combination of components that dissipate residual energy as the present invention. Also, regarding conventional football helmets, the present invention will eliminate the necessity for a chin strap, football game penalties known as a horse collar penalty and a face mask penalty thereby protecting football players from these type injuries due to these type penalties.

This helmet utilizes a completely new means for protecting the head and neck from impacts. In this design, the helmet "orbits" the skull by approximately 2.0-2.5 inches. Thus, no helmet parts make direct contact with the user's head or neck. Conventional helmets sit directly on the skull thus transferring impact energy directly to the head. This results in a wide variety of serious head and neck injuries. This is the first design to eliminate the head from receiving a direct impact.

Conventional helmets fit directly to the head. This transmits a high percentage of the impact energy to the head, brain and spine.

Conventional helmets do not prevent direct impact. At best, all prior helmet designs only reduce the energy, not prevent it.

This design eliminates direct impact altogether. In doing so, the high-energy collision forces that produce a serious head, brain, or spinal injury are greatly reduced or eliminated altogether.

An object of the present invention is to minimize, if not eliminate, direct impact to the head of a user. A further object of the present invention is to minimize injuries to the head of a user. A further object of the present invention is to eliminate concussions and other impact related head and neck injuries. A further object of the present invention is to provide a helmet which can be easily used by an operator. A further object of the present invention is to provide a helmet which can be relatively easily and inexpensively manufactured.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which:

FIG. 3 is a front view of portions of the present invention.

FIG. 4 is a rear view of portions of the present invention.

FIG. 5 is a side view of portions of the present invention.

FIG. 6 is a plan view of portions of the present invention.

LIST OF REFERENCE NUMERALS

Figure 1:
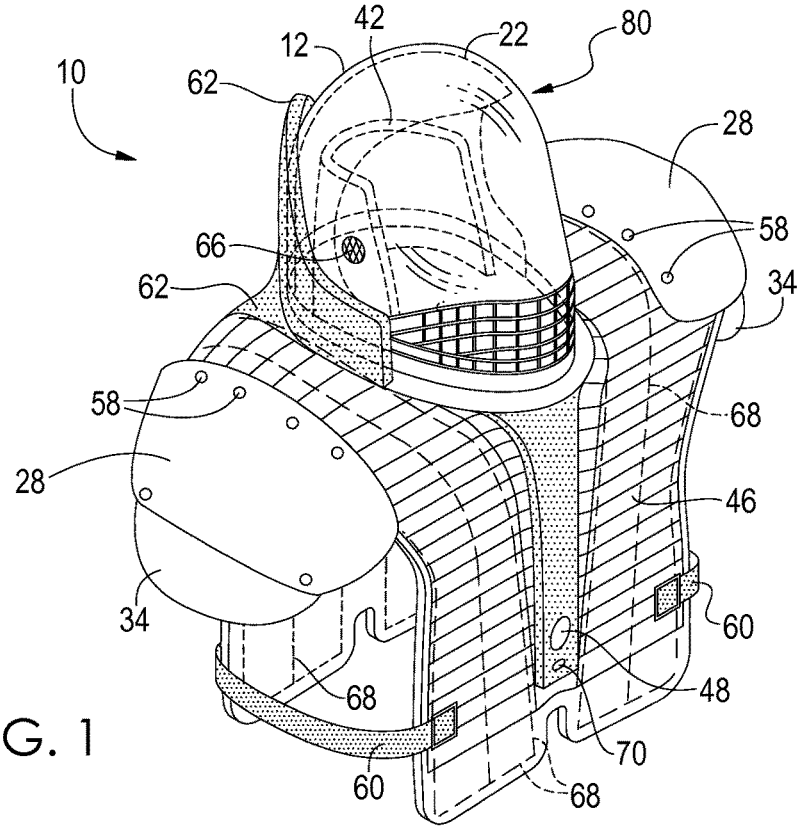
FIG. 1 is a perspective view taken from the front of the present invention.

With regard to reference numerals used, the following numbering is used throughout the drawings.

10 present invention
12 high impact, transparent outer shell
14 high-impact, fine-mesh face mask
16 metal screws
18 grommets
20 high-strength, flexible pegs
22 inner shell
24 camera mount
26 optional wireless camera
28 shoulder pads
30 helmet collar
32 cam locks
34 upper arm pad
36 neck brace
38 upper and lower tubing
40 hinged connection
41 spring
42 flexible head and neck restraint
44 impact gel pads
46 chest pad
48 front ventilation fan
50 back pad
52 rear ventilation fan
54 battery pack
56 compartment, optional electronics
58 metal rivets
60 adjustable straps
62 protective outer collar
64 hook and loop material pads
66 ear vents
68 impact gel strips
70 fan switch
72 grommet holes (inner shell)
74 access opening (cam locks)
76 cavity/space
78 head of user
80 helmet assembly
82 male portion of alignment key
84 female portion of alignment key
86 distance arrow
88 lever of cam lock fitting
90 hinge pin
92 cam head
94 groove
96 central opening
98 housing portion of cam lock
100 safety release button

DETAILED DESCRIPTION OF THE PREFERRED EMBODIMENT

The following discussion describes in detail at least one embodiment of the present invention. This discussion should not be construed, however, as limiting the present invention to the particular embodiments described herein since practitioners skilled in the art will recognize numerous other embodiments as well. For a definition of the complete scope of the invention the reader is directed to the appended claims. FIGS. 1 through 10 illustrate the present invention wherein an improved helmet and shoulder pad assembly is disclosed and which is generally indicated by reference number 10.

Figure 2:
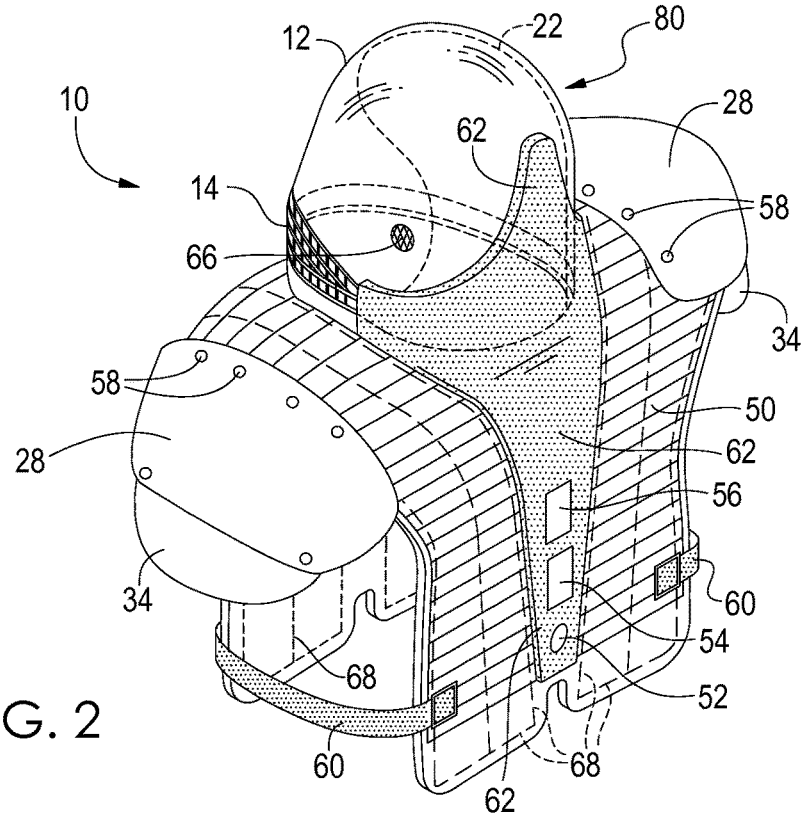
FIG. 2 is a perspective view taken from the rear of the present invention.
Figure 9:
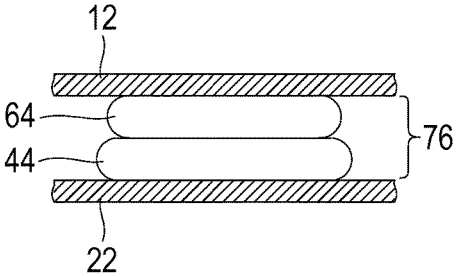
FIG. 9 is an enlarged view of portions of the present invention.
Figure 10:
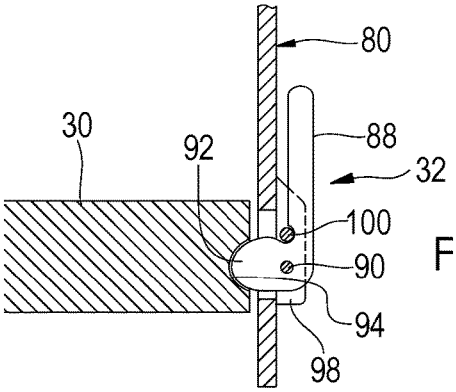
FIG. 10 is a cross section view of the locking member of the present invention.

By reference to FIGS. 1-10, the present invention 10 discloses an energy-absorbing helmet assembly 80 having outer 12 and inner 22 shells which are joined together to form the helmet assembly 80 which is spaced away at 86 from the head of the user 78. The transparent outer shell 12 has a high impact, fine-mesh face mask 14 fastened to it by means of high-strength metal screws 16. The inner shell 22 is manufactured with holes 72 placed in its outer surface of curvature so that energy absorbing members such as impact gel pads 44, hook and loop material 64 and grommets 18 may be pressed into them for the purpose of joining the outer shell 12 to the inner shell 22. Hook and loop material pads 64 (shown in the drawings as a single layer for simplicity although it would be understood by one skilled in the art to require mating pieces) may be optionally attached on top of the impact gel pads 44 in space 76 so as to assist in joining the outer and inner shells 12, 22 as best illustrated in FIG. 9, wherein the optional hook and loop material pads 64 may be provided to strengthen the point of point of joinder between the outer and inner shells 12, 22. To assemble the outer shell 12 to the inner shell 22, the four flexible, high-strength pegs/fasteners or the like 20 attached to the inside of the outer shell 12 are aligned with the circular grommets 18 that line hole 72 so as to become embedded into the inner shell 22 and then the outer shell 12 is pressed onto the inner shell 22. After the pegs 20 are inserted, the outer shell 12 is loosely attached to the inner shell 22. To secure it firmly, the outer shell 12 is pressed all the way down onto the hook and loop material strips 64 and impact gel pads 44. When the outer 12 and inner 22 shells are properly pressed together, the design allows the outer shell 12 to float so that the helmet assembly 80 of the present invention 10 can absorb maximum impact energy without the inner 22 and outer 12 shells separating while maintaining a cavity or space 76 between the inner 22 and outer 12 shells as illustrated in FIG. 9. The inner shell 22 has a built-in camera mount 24 for an optional in-game wireless camera 26. The upper portion of the present invention 10, i.e., the helmet assembly 80 being somewhat oval shaped at its base, is fastened to the shoulder pads 28 via a helmet-mounting collar 30 which is expected to be manufactured as a part of the shoulder pads. The helmet assembly 80 is secured to the collar 30 using locking members such as cam locks 32 or the like, one mounted to each side of the inner shell 22 below the ears as illustrated in FIGS. 5 and 10; FIG. 10 shows a cross-sectional view of the cam lock 32, lever 88, hinge pin 90 and cam head 92 in the mating receiving groove 94 on a lateral surface of collar 30 along with a housing portion 98 for the cam lock and a safety release button 100 which is pushed inwardly to release the lever 88 so that the cam lock 32 can be opened and the helmet assembly 80 removed. The outer shell 12 is manufactured with an access opening 74 at its bottom to allow the user/wearer to operate the cam locks 32. Ear vents 66 are manufactured into the outer shell to permit the wearer to hear. Shoulder pads 28 have upper arm pads 34 attached to each end via rivets 58. Also, a third party neck brace 36 is disclosed having upper and lower tubing portions 38 separated by multiple springs or the like 41 being hingedly connected on its rear portion at 40 so that the upper and lower tubing portions 38 can move toward and away from each other. Neck brace 36 is designed to prevent neck hyper flexion and allows the wearer to rotate his/her head side-to side in a completely unrestricted manner while preventing over-flexation of the neck to the front or side. A vertical, flexible head and neck restraints 42 is located inside both the helmet collar 30 and inner shell 22 and is anchored or attached to the shoulder pads 28 and wraps the sides and rear of the head/neck area and is expected to be either be manufactured as part of or attached later to the shoulder pads. The head and neck restraint 42 significantly decelerates secondary impact energy to prevent lateral and extension injuries to the head and spine. Impact gel strips 68 line the underside of the shoulder pads 28, chest pad 46 and back pad 50 to reduce upper torso shock. The chest pad 46 is contoured with hollow spacing in the middle to allow for a front ventilation fan 48. A similar hollow area is provided in the back pad 50 which allows storage area for a rear ventilation fan 52, a battery pack 54 and compartment for optional electronics 56. A fan switch 70 is recessed into the chest pad wherein it controls both front 48 and rear 52 fans for providing aeration and cooling. The shoulder pad 28, chest pad 46, and back pad 50 are joined together via metal rivets 58, and, these pads are secured firmly to the body of the user/operator by adjustable straps 60 disposed below the arms on each side. A protective outer collar 62 closely surrounds the sides and back of the outer shell 12 and is attached to the shoulder pads 28 and is expected to be either manufactured as part of or attached later to the shoulder pads. This collar 62 prevents all direct impact to the rear of the outer shell 12 whatsoever and also much of the area behind the ear. This protective collar 62 may completely eliminate head and neck injuries resulting from rear impacts and extends from near the middle rear of the helmet 80 all the way down to near the bottom of the back pads 50 as best seen in FIG. 2. The protective outer collar 62 is spaced away from the outer shell 12 a very small distance expected to be about ⅛ inch and being small enough to prevent fingers from being placed between the collar 62 and the outer shell 12 so as to prevent a football game penalty known as a horse collar penalty thereby preventing a potential injury to a football player from this type penalty.

Transparent outer shell 12 entirely surrounds the head of the user, while inner shell 22 only partially covers the head of the user, leaving unblocked a front portion of helmet assembly 80, as illustrated in FIG. 1.

Control of optional electronics and telemetry may require additional software and hardware intelligence.

The greatest concern involved in concussion-prone activities (combat, contact sports, etc.) are the traumatic injuries, including concussions, paralysis, or even death, that result from direct impact and indirect impacts to the head, neck and spine. Despite wearing conventional head protection, serious injuries can occur.

Conventional helmet designs seek to reduce energy rather than prevent it. A wide variety of shock-absorbing materials have been proposed to fill the space between the wearer's skull and the outer helmet shell to decrease impact. At best, these provide a modest level of impact reduction since they still provide a continuous pathway for the impact energy to follow from the outer shell to the wearer's skull, and thereby reach the brain.

Until now, no design has completely isolated the entire neck and skull from direct impact energy while simultaneously and separately supporting the head and neck. The present invention 10 is the first design to achieve this.

The present invention 10 provides an approximate 2.0-2.5 inch air gap/space (illustrated by distance arrow 86 in FIG. 3) between the inner shell 22 and the entire skull or head of a user 78. The dual-shells 12, 22 surrounding but spaced away from the skull absorb and channel all direct impact energy away from the head and neck, and to the shoulders and torso. Unlike any other design, all direct impact energy, which is the most traumatic and destructive, is prevented from reaching the head, and more importantly, the brain. Consequently, this methodology represents a huge breakthrough in head protection. Using this design, concussions and other severe injuries stemming from direct impact could very well be completely eliminated.

Though generally less traumatic, some helmet-related injuries are the result of secondary impact energy. This is similar to the whiplash effect of automotive accidents. The initial impact (direct) occurs when one vehicle strikes another vehicle or object. Whiplash and other secondary injuries occur when internal organs (soft tissue) and the frame of the body (hard tissue) impact one another. When there is direct impact in a helmet collision, the head, which had been stationary, is set in motion. This condition change is known as acceleration. Once the head and neck reach maximum displacement and the whipping motion ceases, soft tissue (the brain, fluids, etc.) continue moving due to inertia. This tissue continues to move until it is slowed or stopped by hard tissue. This is known as deceleration and it produces trauma due to soft tissue impact against hard tissue. Thus, it is crucial to ease deceleration forces in order to reduce secondary injuries from impacts.

The present invention 10 attenuates secondary energy through a tiered system designed to shield secondary energy from reaching the head, neck, spine and torso. Prevention is key, thus the outer protective collar 62 shields the user from all impacts to the rear and side-rear of the head and neck. Secondly, impacts that reach the helmet are reduced by impact gel pads 44 placed between the two helmet shells 12, 22 at points of highest stress—especially the forehead—and on top of the helmet collar 30, wherein the gel pads 44 absorb energy transmitted between the inner and outer shells 12, 22. Energy that remains is transmitted to the shoulder and torso and is further reduced by multiple impact gel strips 68 placed between the shoulder and torso which energy is further reduced by spaced apart multiple impact gel strips 68 placed between the shoulder 28, chest 46 and back pads 50 and the user's body as best seen in FIG. 2 which shows six rows of strips 68 on the interior surface of the front, back, right and left sides and along the bottom edge of pads 28, 46, and 50. Each gel strip 68 is expected to be about ¼ inch thick and about 1 inch long.

To further reduce residual (secondary) energy at the head and neck, a flexible restraint 42, and a third-party neck brace 36 are proposed. Incorporated into the shoulder pad, the vertical head and neck restraint 42 closely surrounds but does not touch the back half of the neck and the head. When impact causes the head and neck to move sideways or backwards, this restraint 42 is contacted and provides progressive resistance to decelerate and to prevent over-extension of the head/neck. Likewise, the third-party neck brace 36 progressively decelerates forward and sideways motion of the head and neck. Thus, many secondary injuries can also be eliminated.

The helmet shells and various pads of the present invention 10 comprise molded, high-strength, lightweight materials (plastic or similar). The impact gel is custom manufactured by a proprietary supplier. The face mask, pegs, mounts, compartments, rivets and straps are already available through multiple sources. Metal screws, fans and battery packs are also readily available and do not require manufacture. Parts assembly is outsourced to avoid staffing and facility costs with quality control handled internally to ensure the necessary exacting standards are met and to minimize liability.

All parts are required in order to provide the safety benefits of the design except the optional components which include: the battery pack, fans, camera, and any electronics.

Adding options, such as a biometric monitor, will make it possible to better monitor the health of the user/wearer as well as keep them cooler if forced ventilation is used. Optional electronic features such as, but not limited to, an accelerometer, g-force gauge, etc., can also yield information of interest such as user position, speed and embedded (in-game) audio-video.

To place the present invention 10 on the user 78, the user dons the pads 28 just as the user would conventional football shoulder pads. In this design, however, the shoulder pad assembly or unit includes three pieces joined together: the shoulder pads 28, chest pads 46 and back pads 50, riveted or otherwise joined together to form a single unit or assembly. This assembly, having a central opening 96 therein for receiving the head 78 of a user, is placed over the head 78, pulled down onto the shoulders, and secured using the adjustable straps 60 under each arm. When the user 78 wishes to put on the helmet 80, he/she places male alignment tab 82 into the female alignment hole 84 and the helmet is pulled over the head and onto its associated collar 30 using the male and female alignment keys/tabs 82, 84. Once it is in place, the cam locks 32 are locked down, one on each side of the helmet 80. Once the shoulder pad 28, 46, 50 and helmet 80 are secured, the wearer 78 is ready to engage in activity.

The present invention 10 is applicable to virtually any environment that may encounter strong and sudden impacts or collisions. Such uses include, but are not limited to, aviation, military, construction, and contact sports applications. For example, all levels of football will benefit from using the design to protect their players from direct and indirect impact injuries.

It is capable of protecting persons involved in any number of dangerous activities such as, but not limited to, warfare, combat, bomb disposal, aviation, construction, law enforcement, fire protection, motor sports, winter sports, e.g., skiing, and many other similar activities.

Figure 7:
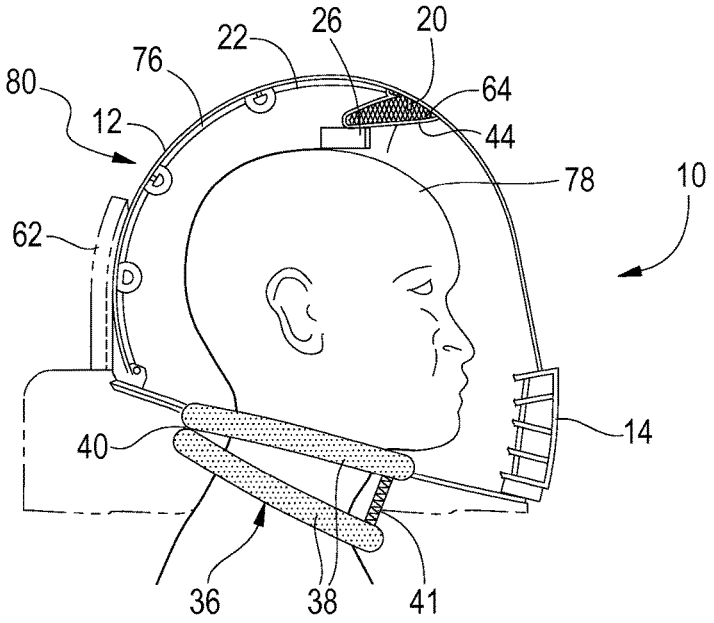
FIG. 7 is a side view of portions of the present invention.
Figure 8:
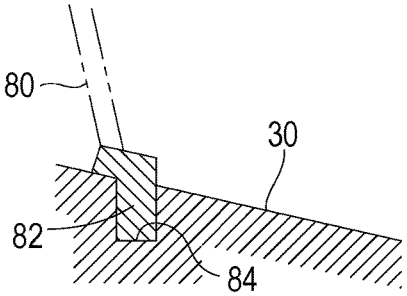
FIG. 8 is an enlarged view of the alignment key taken generally from FIG. 7.

A more detailed discussion of the third-party neck brace 36 illustrated in FIG. 7 follows: note that flexation involves forward movement and extension involves backward movement of the head/neck. The neck brace 36 wraps around the entire neck below the chin and head of the user 78 and it is then secured in place by a hook and loop strap. The brace 36 allows the wearer 78 to rotate his/her head side-to side in a completely unrestricted fashion while preventing over-flexation of the neck to the front or side. (The inner neck restraint 42 addresses energy concerns behind the ear and to the rear.) It does this through the following mechanical means: As the user's 78 neck/head begins to flex (move forward), the wearers jaw comes into contact with the rubber padded surface of the upper portion of the brace 38 which, in turn, forces the lower portion of the brace downwardly against the top of the sternum. At this point, deceleration begins. Any further neck flexation meets with resistance from the metal springs 41. These springs 41 are designed to progressively decelerate the flexing action such that all energy is absorbed and the flexation of the head is stopped. Through progressive deceleration—by means of flexible and/or shock absorbing materials—potentially harmful energy is dissipated and injury to the spine and brain is prevented. The neck brace 36 includes the following parts: a) the structure is flexible plastic tubing 38; b) plastic "T's" connect the tubing 38 to the shock absorbing metal springs 41 and there is a plastic "T" on both ends of each spring; c) shock absorbing metal springs 41 absorb impacts due to neck flexion; and, d) rubber padding (not shown) which is hollow in the middle allowing it to be slipped onto the plastic tubing 38. The brace 36 is easily wrapped around the users neck and secured by a hook & loop strap.

I claim:

1. A method for protecting a head, a neck and a spine of a user, the method comprising the following steps of:

a) mounting a shoulder pad assembly on the shoulders of the user so that the shoulder pad assembly covers a portion of a front and a portion of a rear of the user, said shoulder pad assembly having a central opening so that the head of the user passes through said central opening;

b) disposing a head and neck restraint on the shoulder pad assembly so that the head and neck restraint extends above portions of the head and neck of the user;

c) disposing a helmet assembly removably on the shoulder pad assembly so that the helmet assembly is completely spaced away from the head of the user thereby providing and maintaining an air space between the head of the user and the helmet assembly during use;

d) wherein the helmet assembly comprises a molded, high-strength outer shell of transparent material entirely surrounding the head of the user and an inner shell partially covering the head of the user so that the head and neck restraint is upwardly disposed inside the inner shell, said inner shell joined to said outer shell with spaced apart energy absorbing members and leaving a front portion of said outer shell uncovered by the inner shell;

e) disposing a protective outer collar on the shoulder pad assembly so that the protective outer collar extends over portions of a back and an outside of the outer shell.

2. The method of claim 1, further comprising a step of disposing a fine-mesh face mask on the front portion of the outer shell.

3. The method of claim 1, wherein the shoulder pad assembly includes a shoulder pad portion, a chest pad portion and a back pad portion.

4. The method of claim 1, further comprising a step of disposing a plurality of spaced apart shock absorbing strips on an inner surface of the shoulder pad assembly.

5. The method of claim 1, wherein the inner shell is joined to the outer shell of the helmet assembly using a plurality of fasteners.

6. The method of claim 1, further comprising a step of di sing left and right ear vents in the outer shell of the helmet assembly, the ear vents being uncovered by said inner shell.

7. The method of claim 1, further comprising a step of disposing a ventilation fan in the shoulder pad assembly.

8. The method of claim 1, further comprising a step of disposing a camera in the helmet assembly.

9. The method of claim 1, wherein the helmet assembly is secured onto to the shoulder pad assembly using a locking member.

* * * * *